United States Patent [19]

Collins

[11] 4,101,801

[45] Jul. 18, 1978

[54] SHIELDED CATHODE SUPPORT STRUCTURE

[75] Inventor: Floyd K. Collins, Seneca Falls, N.Y.

[73] Assignee: GTE Sylvania Incorporated, Stamford, Conn.

[21] Appl. No.: 791,867

[22] Filed: Apr. 28, 1977

[51] Int. Cl.[2] ..... H01J 29/02; H01J 29/82

[52] U.S. Cl. ..... 313/417; 313/451

[58] Field of Search ..... 313/446, 417, 409, 451, 313/456, 447

[56] References Cited

U.S. PATENT DOCUMENTS

| | | | |
|---|---|---|---|
| 3,351,792 | 11/1967 | Kuryla | 313/451 X |
| 3,549,929 | 12/1970 | Pappadis | 313/446 X |
| 4,063,128 | 12/1977 | Hughes | 313/409 |

*Primary Examiner*—Robert Segal
*Attorney, Agent, or Firm*—Thomas H. Buffton

[57] ABSTRACT

A shielded cathode support structure for electron gun assemblies of a cathode ray tube includes a cup-shaped control grid electrode, a cathode having emissive coating on a closed end, an eyelet member having one end affixed to and supporting the cathode and the opposite end flared and disposed within the control grid electrode to combine to provide a shield for cathode sublimation, and a support member having an upstanding flared portion surrounding an aperture for receiving the eyelet member and for contacting the flared end of the eyelet member with the support member affixed to an insulator rod of the electron gun assembly.

8 Claims, 4 Drawing Figures

SHIELDED CATHODE SUPPORT STRUCTURE

BACKGROUND OF THE INVENTION

This invention relates to electron gun assemblies for cathode ray tubes and more particularly to shielded cathode support structures for inhibiting deleterious results caused by cathode sublimation.

In cathode ray tube structures of either the so-called in-line or delta-gun construction, it is a common practice to provide insulating rods of a glass-like material. The various electrodes of the gun assemblies are embedded in the insulating rods to provide a desired spacing and electrical insulation intermediate the electrodes.

As is well known, an electrical heater is inserted into the open end of a cathode structure and a layer of electron emissive material is affixed to the opposite or closed end of the cathode sleeve. Since it is desired to utilize the heat derived from the electrical heater at a maximum efficiency in order to attain a fast warm-up of the cathode ray tube and to inhibit sublimation of the cathode structure due to the applied heat, it has been a common practice to provide a shield member and a support member for each cathode structure.

One known form of shield and support member utilized with cathodes in a cathode ray tube electron gun assembly is disclosed in U.S. Pat. No. 3,351,792 assigned to the assignee of the present application. Therein, a support member has oppositely disposed first portions formed for attachment to insulator rods and a second portion normal thereto with a central aperture. A dual-wall eyelet has one end affixed to the cathode electrode, extends upwardly along the axis of the cathode, and is bent back upon itself to provide a ledge. This entire cathode and eyelet, except for the ledge of the eyelet, pass through the aperture of the support member and the ledge and support members are attached to one another. Thus, the cathode electrode is fixedly attached by way of the eyelet to the support member.

Also, the cathode and dual-wall eyelet have upper and lower portions of different diameters to provide for attachment of the structures at the lower portions and a space therebetween at the upper portions. Moreover, the emissive material affixed to the cathode electrode extends beyond the end of the dual-walled eyelet.

As to operation, the dual-walled eyelet provides support for the cathode at the open end thereof which is furthest from the closed end having emissive material thereon whereat maximum heat is desired. Thus, support of the cathode is achieved with minimum heat loss. Also, the dual-walled eyelet is spaced from the cathode which minimizes conductive and radiated heat losses therefrom while serving as a shield for cathode sublimation.

Although the above-mentioned apparatus has been and still is extensively utilized in numerous applications, it has been found that there are circumstances wherein improvements can be made. For example, it has been found that the above-mentioned dual-wall eyelet structure tends to occupy an excessive space when employed in a cathode ray tube having a relatively small neck-size. Also, it has been found that a reduction in size of the eyelet member tends to undesirably cause increased cleaning problems when a dual-wall structure is employed.

OBJECTS AND SUMMARY OF THE INVENTION

An object of the present invention is to provide a structure which reduces the aforementioned problems in an electron gun for small-necked cathode ray tubes. Another object of the invention is to provide an enhanced shielded cathode support structure for an electron gun assembly of a cathode ray tube. Still another object of the invention is to provide an improved sublimation shield at a reduced cost and employing a reduced quantity of material and workmanship. A further object of the invention is to provide an improved shielded cathode support having an enhanced cleaning capability, a reduced cost, and a permissable increase in dimensional tolerances.

These and other and further objects, advantages and capabilities are achieved in one aspect of the invention by a shielded cathode support structure having a cathode affixed to an eyelet with a flared end and a support member formed for attachment to an insulator rod and having an upstanding flared portion contacting the flared end of the eyelet.

PREFERRED EMBODIMENT OF THE INVENTION

For a better understanding of the present invention, together with other and further objects, advantages and capabilities thereof, reference is made to the following disclosure and appended claims in conjunction with the accompanying drawings.

Figure 1:
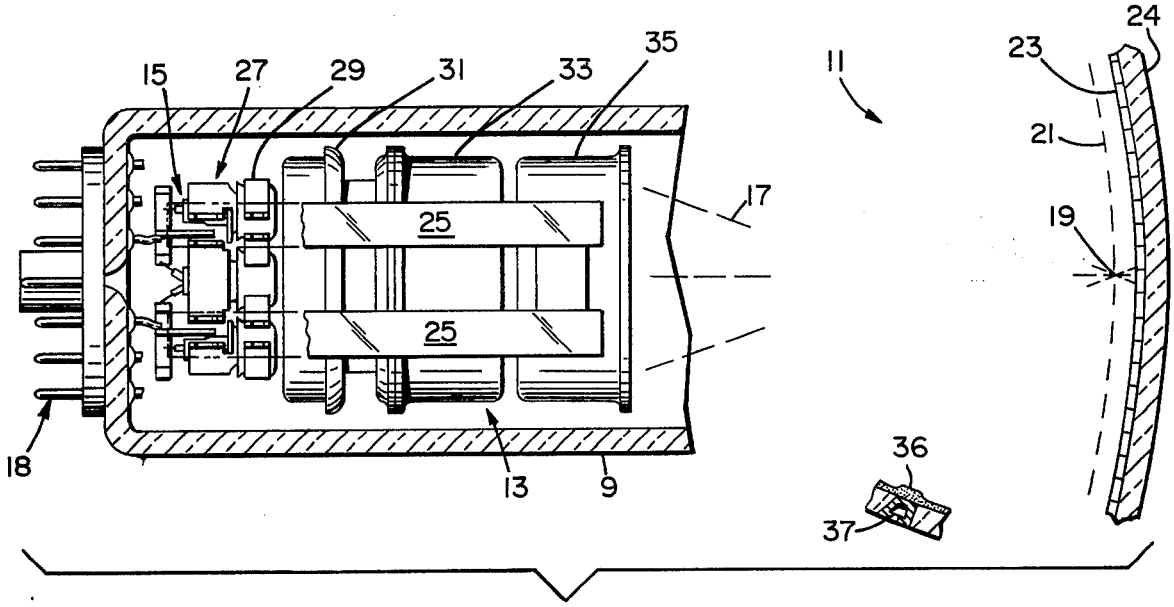
FIG. 1 is a partial plan view of the neck portion illustrating an electron gun assembly for a cathode ray tube.

Referring to the drawings, FIG. 1 illustrates a typical three-gun assembly of a color cathode ray tube for providing a visual display on a color television receiver. The cathode ray tube includes a neck portion 9 which is connected by way of funnel portion (not shown) to mask panel assembly 11 whereon the visual display appears. An electron gun assembly 13 includes three electron guns 15 aligned in a plane with each of the electron guns 15 generating an electron beam 17 which passes through an aperture 19 in an aperture mask 21 to impinge a phosphor layer 23 deposited on the faceplate 24 to provide the visual display.

The electron guns 15 each include a plurality of electrodes which are axially disposed with each electrode embedded in and supported by one or more insulator rods 25. Each of the electron guns 15 includes a cathode assembly 27, a first cup-shaped grid electrode 29, a second grid electrode 31 and a third grid electrode 33, and an HV anode electrode 35. As is well known, the cathode assembly 27 functions to generate an electron beam 17 which is modulated by the cathode assembly 27 or the control grid electrode 29, is initially accelerated by the second, or screen, grid electrode 31, focused by the third grid electrode 33, and given a final acceleration by a fourth or terminal grid electrode 35. Moreover, operating voltages are applied to the electron gun elements via base pins 18 and a high voltage connector means 37 sealed in the previously-mentioned funnel portion of the cathode ray tube which is connected to the fourth grid 35 by means of internal conductive coating 36 placed on the inside of the funnel.

Figure 2:
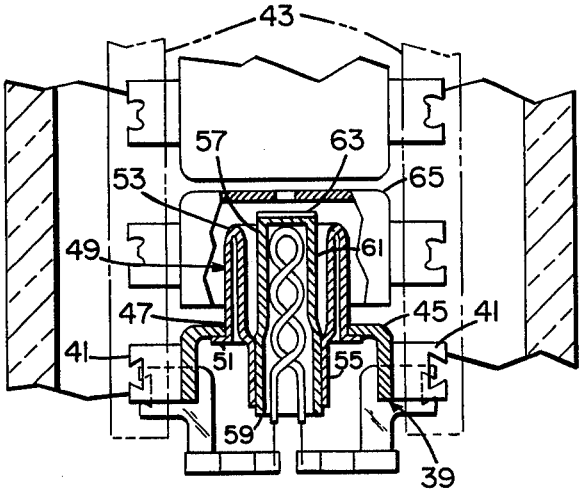
Fig. 2 PRIOR ART
FIG. 2 is an enlarged sectional view of a prior art form of cathode support structure.

Referring to the cathode assembly 27, FIG. 2 illustrates a prior art form of construction. Herein, a support member 39 includes a pair of oppositely disposed first sections 41 formed for and embedded in a pair of insulator rods 43 of glass-like material. The support member 39 has a second section 45 substantially normal to the first sections 41 which includes a central aperture 47.

An eyelet 49 in the form of a dual-walled structure bent back upon itself is disposed within the central aperture 47 of the support member 39. The eyelet 49 has a ledge member 51 extending outwardly therefrom which is affixed to the second section 45 of the support member 39 by welding or other equally appropriate means. The eyelet 49 has a dual-walled portion 53 extending above the second section 45 of the support member 39. This dual-walled portion 53 has a given inner diameter and extends into a single-walled structure 55 positioned below the second section 45 of the support member 39. This single-walled structure 55 is of an inner diameter less than the inner diameter of the dual-walled portion 53.

A cathode member 57 is disposed within the eyelet 49 and has an open end portion 59 of a diameter substantially similar to the inner diameter of the single-walled structure 55 of the eyelet 49 and is affixed thereto. The cathode member 57 also has a closed end portion 61 of a diameter smaller than the diameter of the open end portion 59. The closed end portion 61 of the cathode member 57 extends beyond the dual-walled portion 53 of the eyelet 49 and has a layer of electron emissive material 63 affixed thereto. A control grid 65 surrounds most of the dual-walled portion 53 of the eyelet 49 as well as the electron emissive coated closed end portion 61 of the cathode member 57.

Figure 3:
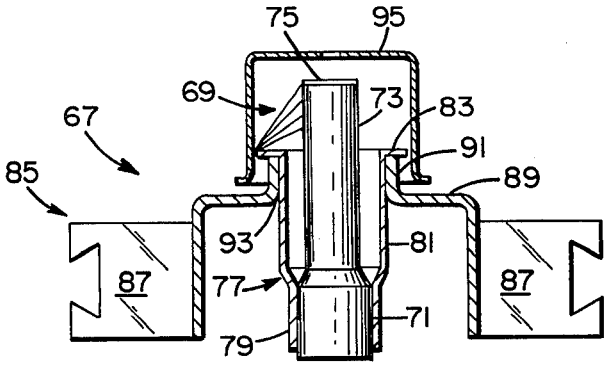
FIG. 3 is an enlarged sectional view of an embodiment of the present invention showing a preferred form of shielded cathode support structure.

Referring now to FIG. 3, a preferred form of cathode assembly 67 is illustrated. Thereat, a cathode element 69 has an open or lower end 71 of a given diameter which is tapered to a smaller diameter upper or closed end portion 73 having a layer of electron emissive material 75 deposited on or affixed to the closed end portion 73.

An eyelet member 77 has a dual diameter with the smaller diameter lower end portion 79 thereof substantially similar to the diameter of the lower open end 71 of the cathode element 69 and affixed thereto by welding or other similar means. The larger diameter upper end portion 81 of the eyelet member 77 is spaced from the closed upper end portion 73 of the cathode element 69 and extends longitudinally therealong with the electron emissive material coated cathode element 69 extending beyond the eyelet member 77. The larger diameter upper end portion of the eyelet 77 ends in an outwardly flared portion 83.

A support member 85 has a pair of oppositely disposed first sections 87 formed for embedment within one or more insulator rods (not shown). The support member 85 has a second section 89 substantially normal to the first sections 87. The second section 89 has a flared upstanding portion 91 which forms a substantially centered aperture 93. The central aperture 93 is of a diameter to receive the larger diameter upper end portion 81 of the eyelet member 77 with the outwardly flared portion 83 of the eyelet member contacting and resting upon the flared upstanding portion 91 of the support member 85. Moreover, attachment of the upper end portion 81 of the eyelet member 77 and the flared upstanding portion 91 of the support member 85 is provided.

A cup-shaped control grid electrode 95, which is normally affixed to insulator rods (not shown), is included in the drawing to illustrate the shielding effects thereof in combination with the shielding provided by the outwardly flared portion 83 of the eyelet member 77. Thus, the eyelet member 77 serves to provide shielding from sublimation emanating from the cathode element 69 for the insulator rods 25 and electrodes attached thereto as well as the neck portion 9 of the cathode ray tube (FIG. 1).

Figure 4:
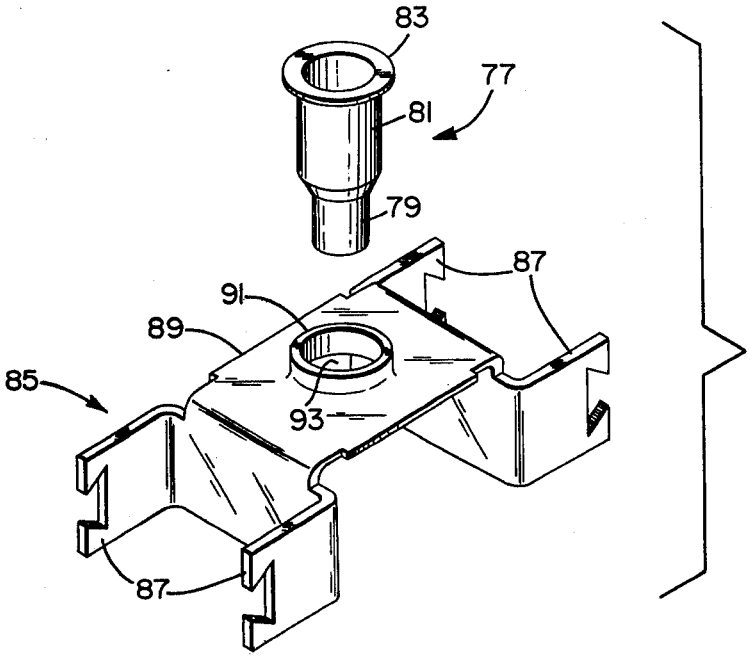
FIG. 4 is an isometric view of the support structure and eyelet member of the embodiment of FIG. 3.

For a clearer illustration of the enhanced eyelet and support members, 77 and 85 respectively, reference is made to FIG. 4 of the drawings. Therein, the eyelet member 77 includes a smaller diameter lower end portion 79 which tapers to a larger diameter upper end portion 81. The larger diameter upper end portion 81 has an outwardly flared portion 83 which serves as a sublimation shield as will be explained hereinafter.

The support member 85 includes oppositely disposed first sections 87 and a second section 89. The first sections 87 are formed for embedment in insulator rods (not shown). The second section 89, substantially normal to the first sections 87 has an upstanding portion 91 formed to provide a substantially central aperture 93. This central aperture 93 is of a diameter to receive the larger diameter upper end portion 81 of the eyelet member 77 with the flared portion 83 thereof contacting and extending outwardly from the upstanding portion 91 of the support member 85.

Referring to FIG. 3 for operation, the eyelet member 77 is attached to the cathode element 69 at the lower open end 71 whereby heat conduction losses from the cathode element 69 are minimized. The upper end portion 81 of the eyelet member 77 has a relatively polished heat reflective inner surface which is spaced adjacent to the upper closed end portion 73 of the cathode element 69 and serves to reduce heat losses therefrom by radiation. Moreover, the reflective inner surface of the eyelet member 77 in conjunction with the above-mentioned form of attachment thereto of the cathode element 69 tends to increase the efficiency and decrease the warm-up time of the cathode element 69.

Further, the eyelet member 77 serves as a sublimation shield whereby deposition on the neck portion or support rods of materials sublimed by the cathode element 69 is inhibited. As can readily be seen in FIG. 3, the outwardly flared portion 83 of the eyelet member 77 and the cup-shaped control grid electrode tend to shield the second section 89 of the support member 85.

Thus, there has been provided a unique shielded cathode support structure which is inexpensive of materials, fabrication, and installation costs. The simplified structure greatly reduces the cleaning and processing costs and problems and provides an improved reliability. Also, the improved structure is easily fabricated with reduced tolerances whereby the desired shielding uniformity is more easily attained than in any prior known structure.

While there has been shown and described what is at present considered the preferred embodiment of the invention, it will be obvious to those skilled in the art that various changes and modifications may be made therein without departing from the invention as defined by the appended claims.

What is claimed is:

1. In a cathode ray tube having a control grid and an electron gun assembly with at least one insulator rod supporting a plurality of electrode elements, a shielded cathode support structure comprising:

a cup-shaped control grid electrode affixed to said insulator rod;

a cathode having an open end and a closed end with said closed end having a layer of electron emissive material thereon and located within said cup-shaped control grid electrode;

an eyelet member having upper and lower portions, said upper portion having a flared end within said cup-shaped control grid electrode and said lower portion having a diameter suitable for attachment to said cathode; and a support member having a first section formed for attachment to said insulator rod and a second section in a plane substantially normal to said first section, said second section having a flared upstanding portion which surrounds a central aperture of a size to receive said eyelet member and provides a contacting surface for said flared portion of said eyelet member whereby said flared portion of said eyelet member and said cup-shaped control grid electrode serve to shield said insulator rod and electrode elements therein from cathode sublimation.

2. The shielded cathode support structure of claim 1 wherein said cathode is substantially cylindrical-shaped with upper and lower portions of differing diameters with said upper portion of a diameter less than the diameter of said lower portion and said eyelet member having differing diameters with said upper portion of a diameter greater than the diameter of said lower portion whereby said lower portions of said cathode and eyelet are formed for attachment therebetween and said upper portions of said cathode and eyelet have a space therebetween for effecting shielding of said cathode.

3. The shielded cathode support structure of claim 1 wherein said support member is of a form to provide oppositely disposed first sections formed for attachment to oppositely disposed insulating rods.

4. The shielded cathode support structure of claim 1 wherein said support member is in the form of three individual identities aligned in a common plane with each identity associated with a cup-shaped control grid electrode and having a first section formed for attachment to said insulator rod and a second section normal to said first section with a flared portion surrounding a central aperture and a flared end of an eyelet member contacting said flared portion of said second section of each identity of said support member.

5. In an inline cathode ray tube having an electron gun assembly which includes a plurality of cathodes aligned in a single plane and a plurality of electrode elements supported by at least one insulator rod, a shielded cathode support structure comprising:

a plurality of cup-shaped control grid electrodes affixed to said insulator rod;

a plurality of cathodes each having an open end and a closed end with a layer of electron emissive material affixed to said closed end and the closed end of a cathode disposed within each one of said plurality of cup-shaped control grid electrodes;

a plurality of eyelet members each associated with one of said cathodes and having upper and lower portions of different diameters, said upper portion having a flared end disposed within a cup-shaped control grid electrode and said lower portion having a diameter formed for attachment of each of said eyelet members to one of said cathodes; and a plurality of support members each associated with one of said cathodes and one of said eyelet members and one of said cup-shaped control grid electrodes and having a first section formed for attachment to said insulator rod and a second section in a plane substantially normal to said first section, said second section having a flared upstanding portion surrounding a central aperture of a size for receiving said eyelet member and providing contact and support for said flared end of said eyelet member whereby said flared end of said eyelet member and said cup-shaped control grid electrode serve to shield said electrode elements and insulator rod from cathode sublimation.

6. The shielded cathode support structure of claim 5 wherein each of said cathodes and eyelet members is cylindrically shaped with upper and lower portions, said cathode having a lower portion of a diameter greater than the diameter of an upper portion and each of said eyelet members having an upper portion of a diameter greater than the diameter of said lower portion to provide contact of said lower portions and spacing between said upper portions of each of said cathode and eyelet members.

7. The shielded cathode support structure of claim 5 wherein each one of said plurality of support members includes a pair of diametrically opposed first sections formed for attachment to a pair of spaced insulator rods.

8. The shielded cathode support structure of claim 5 wherein said flared end of said eyelet member is of a diameter greater than the diameter of said flared upstanding portion of said support members and serves with said cup-shaped control grid electrode to provide shielding of said insulator rods from cathode sublimation.

* * * * *